United States Patent [19]

Mamyrin et al.

[11] 4,072,862

[45] Feb. 7, 1978

[54] TIME-OF-FLIGHT MASS SPECTROMETER

[76] Inventors: Boris Alexandrovich Mamyrin, prospekt Toreza, 9, kv. 89; Valery Ivanovich Karataev, Grazndansky prospekt, 70, kv. 36; Dmitry Viktorovich Shmikk, Olginskaya ulitsa, 12, kv. 27, all ofLeningrad, U.S.S.R.

[21] Appl. No.: 695,409

[22] Filed: June 14, 1976

Related U.S. Application Data

[63] Continuation of Ser. No. 598,026, July 22, 1975, abandoned.

[51] Int. Cl.[2] ..... H01J 39/34

[52] U.S. Cl. ..... 250/286; 250/287

[58] Field of Search ..... 250/287, 286, 281, 282, 250/283, 284

[56] References Cited

U.S. PATENT DOCUMENTS

| | | | |
|---|---|---|---|
| 2,621,242 | 11/1971 | Ferguson | 250/287 |
| 3,626,182 | 12/1971 | Cohen | 250/287 |
| 3,727,047 | 4/1973 | Janes | 250/287 |

*Primary Examiner*—Craig E. Church
*Attorney, Agent, or Firm*—Holman & Stern

[57] ABSTRACT

The invention relates to a nonmagnetic time-of-flight mass spectrometer whose analyzer chamber accommodates a pulsed ion source, an ion detector and an ion reflecting system disposed on one and the same ion-optical axis. The ion detector and the ion reflecting system are disposed on opposite sides of the ion source. The ion source comprises a source wherein all electrodes are transparent to the ions studied.

17 Claims, 5 Drawing Figures

TIME-OF-FLIGHT MASS SPECTROMETER

FIELD OF THE INVENTION

The present invention relates to mass spectrometers and, more particularly, to time-of-flight mass spectrometers. Instruments embodying the invention may be employed in scientific studies and in practice for mass-spectrometric investigations of various substances.

BACKGROUND OF THE INVENTION

In the time-of-flight mass spectrometer, charged particles are analyzed by their mass-to-charge ratio which is determined by measuring the time of flight of the charged particles between two given points, e.g. between the ion source and the ion detector.

It is known in the prior art to employ nonmagnetic time-of-flight mass spectrometers comprising a pulsed ion source, a field-free ion drift space and an ion detector, all said elements being disposed on one and the same ion-optical axis. Among the advantages of such mass spectrometers are:

the possibility of recording a mass spectrum in a few microseconds;

the possibility of panoramic display of the entire mass spectrum and any individual parts thereof;

an unlimited mass range for the ions studied;

a relatively simple design.

Such prior art devices, however, have a major deficiency, viz. poor resolution, which cannot be made greater than several hundred for apparatus parameters in conventional practice.

There also exists in the prior art a nonmagnetic time-of-flight mass spectrometer which comprises an analyzer chamber wherein are disposed, on one and the same ion-optical axis, a pulsed ion source, an ion detector and an arrangement making up for the spread in the times of flight through the field-free space of ions of different energies, viz. an ion relfecting system, which is disposed between the ion source and the ion detector on the ion trajectory.

The advantages offered by this latter prior art device are the same as those of the farmer prior art time-of-flight mass spectrometers described hereabove, i.e. speed of action, panoramic display of the entire mass spectrum and any individual parts thereof, and unlimited mass range for the ions studied. In addition, the latter device has high resolution, up to several thousand at half-height of mass peaks. However, the ion-optical axis in such a prior art device is a broken line: two portions of the ion trajectory (from the source to the reflecting system and from the reflecting system to the detector) must in principle be inclined to the axis of the device, whereas the ion packet plane must be invariably perpendicular to the ion-optical axis. Thus, a special deflection system has to be employed, which adds to the complexity of design and requires an increase in the lateral dimensions of the analyzer chamber. Use of this prior art deflection system brings about difficulties in the use of ion beam focusing systems as well as in the procedure of sample introduction in the ion source, what with the unavoidable nearness of the source and the detector. These deficiencies make it practically impossible to develop devices with a drift space of small length.

OBJECTS OF THE INVENTION

It is an object of the invention to provide a time-of-flight mass spectrometer combining the advantages of a small analyzer chamber with high resolution, on the order of several thousand.

It is another object of the invention to provide a time-of-flight mass spectrometer affording easy access to the ion source.

It is yet another object of the invention to provide a time-of-flight mass spectrometer simple in design and allowing the elimination of a deflection system.

SUMMARY OF THE INVENTION

The foregoing objects are attained by the time-of-flight mass spectrometer disclosed herein. The analyser comprises an analyzer chamber wherein there are a pulsed ion source, an ion detector and an ion reflecting system arranged on one and the same ion-optical axis. In accordance with the invention, the ion detector and the ion reflecting system are disposed on opposite sides of the pulsed ion source and all electrodes of the latter are transparent to the ions studied.

The pulsed ion source may be formed as two electrodes constituting the walls of the ionization chamber of the source perpendicular to the ion-optical axis.

The pulsed ion source is preferably provided with a third electrode arranged in parallolism with the first two electrodes and disposed near the ionization chamber on the side thereof facing toward the detector.

The pulsed ion source is also preferably provided with a fourth electrode arranged in parallelism with the first three electrodes and disposed near the ionization chamber on the side thereof facing toward the ion reflecting system.

The ion reflecting system may be constituted by a single electrode non-transparent to the ions studied and arranged in parallelism with the electrodes of the ion source.

The ion reflecting system is desirably provided with a second electrode transparent to the ions studied, arranged in parallelism with the first one and disposed between said first electrode and the pulsed ion source.

The ion reflecting system is preferably provided with a third electrode transparent to the ions studied, arranged in parallelism with the first and second electrodes and disposed between the second electrode and the pulsed ion source.

The time-of-flight mass spectrometer in accordance with the present invention offers the following advantages.

In this device, the ions move along unbroken rectilinear trajectories parallel to the axis of the analyzer chamber, thereby permitting a reduction in the lateral dimensions of the chamber. Since in this device the ion packet plane is always perpendicular to the ion-optical axis, the ion deflection system can be dispensed with.

All the difficulties associated with the nearness of the ion source and the ion detector are thus eliminated; free space is available for installing the ion source; and ready access to the ion source is assured, affording convenient use of sample inlet arrangements, vacuum locks for sample replacement, inspection ports for pyrometry, etc. Furthermore, the sensitive ion detector is thereby insulated from the harmful influence of pulsed voltages fed to the ion source.

The present invention makes it feasible to manufacture series of devices with a standard analyzer chamber but differing in analytical characteristics. Thus, it is now possible to develop both a device of resolution of the order of 3,000 at a drift space length of the order of 1 meter and a small-size mass spectrometer with a resolution in excess of 100 at a drift space length of the order of 10 cm.

DESCRIPTION OF THE FIGURES

The invention will be further understood from the following detailed description of several exemplary embodiments thereof taken in conjunction with the accompanying drawings, wherein.

DISCUSSION OF THE PREFERRED EMBODIMENT

Figure 1:
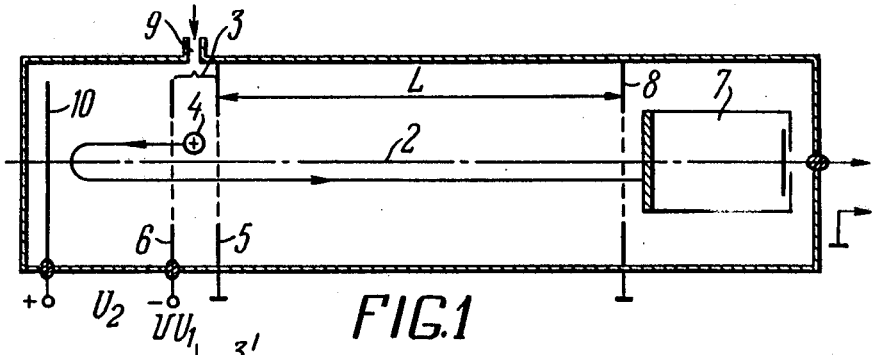
FIG. 1 schematically illustrates, in longtiudinal section, a time-of-flight mass spectrometer with an ion source composed of two electrodes.

Referring now to the drawings, the time-of-flight mass spectrometer, shown in longitudinal section in FIG. 1, comprises an analyzer chamber 1 wherein there is disposed a pulsed ion source 3 composed of two electrodes 5 and 6 transparent to the ions 4 under study, the ion source 3 being disposed on an ion-optical axis 2 which constitutes a straight line co-inciding with the geometric axis of the chamber 1, and the electrodes 5 and 6, which constitute the walls of the ionization chamber, being disposed in perpendicular relationship with the ion-optical axis 2. On one side of the ion source 3 in the chamber 1 there is disposed an ion detector 7. In front of the ion detector 7 there is disposed an electrode 8. The gap between the electrode 5 and the electrode 8 constitutes an equipotential ion drift space of length L. Should a secondary-emission electron multiplier be employed as the ion detector 7, as is the case in the embodiments described herein, the electrode 8 performs an additional function of accelerating the ions in front of the multiplier. The ion detector 7 may likewise be constituted by a magnetic electron multiplier or an ion collector formed as a plane metal plate connected to a signal indicator.

In the wall of the analyzer chamber 1 there is provided an inlet port 9 for introducing the sample to be analyzed into the ionization chamber of the ion source 3.

On the other side of the ion source 3 in the chamber 1 there is disposed an ion reflecting system built around a single electrode 10 non-transparent to the ions studied and arranged in parallelism with the electrodes of the ion source 3.

Figure 2:
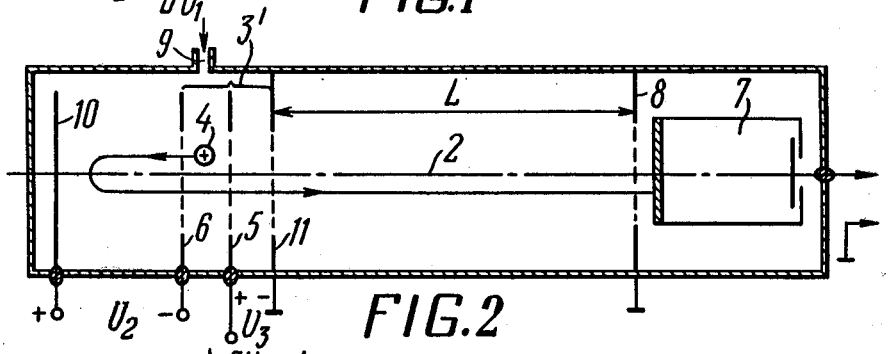
FIG. 2 is a longitudinal sectional view of a mass spectrometer with an ion source composed of three electrodes.

FIG. 2 illustrates a mass spectrometer whereof an ion source $3^I$, as distinct from the previous embodiment, comprises a third electrode 11 likewise transparent to the studied ions 4. The electrode 11 is disposed normally to the ion-optical axis 2 near the ionization chamber on the side thereof facing toward the ion detector 7. The electrode 11 is designed to accelerate the ions in the gap between the electrodes 5 and 11.

Figure 3:
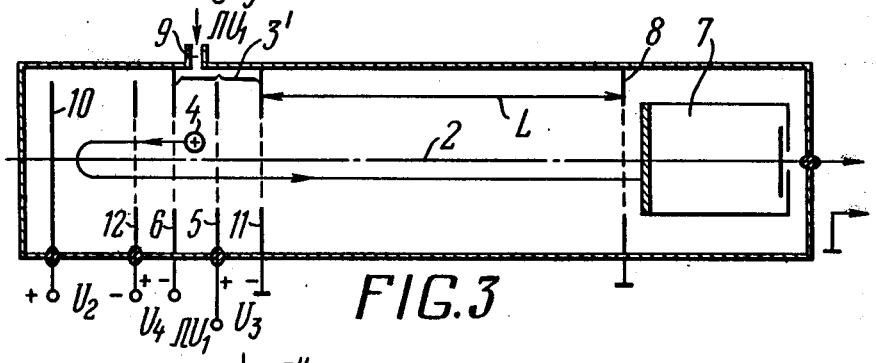
FIG. 3 is a longitudinal sectional view of a mass spectrometer with an ion reflecting system composed of two electrodes.

FIG. 3 shows a mass spectrometer whereof the ion reflecting system, as distinct from that of the embodiment illustrated in FIG. 2, comprises two electrodes 10 and 12 arranged in parallelism with the electrodes 5, 6 and 11 of the ion source $3^I$. In this case the reflecting system is a double-gap one sequentially retarding the ions as they move from the ion source $3^I$ toward the ion reflecting system. One gap is defined by the electrodes 10 and 12 while the other by the electrodes 12 and 6, the electrode 6 being in this case shared by the ionization chamber of the ion source $3^I$ and the ion reflecting system.

Figure 4:
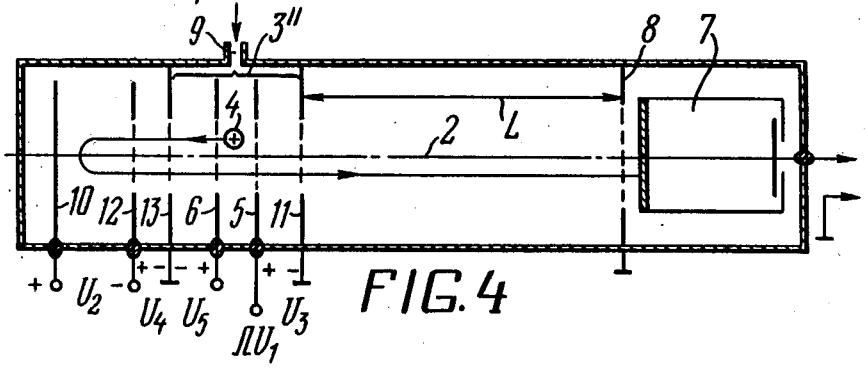
FIG. 4 is a longitudinal sectional view of a mass spectrometer with an ion source composed of four electrodes.

FIG. 4 illustrates a mass spectrometer with an ion source $3^{II}$ which, as distinct from that of the embodiment showed in FIG. 3, comprises four electrodes 5, 6, 11 and 13, the fourth electrode 13, likewise transparent to the ions studied, being parallel to the former three electrodes. In this case the gap between the electrodes 6 and 13 serves to accelerate the ions moving from the source $3^{II}$ toward the ion reflecting system. The electrode 13 is shared by the ion source $3^{II}$ and the ion reflecting system. The electrode 13 forms an accelerating gap with the electrode 6 and a retarding gap with the electrode 12.

Figure 5:
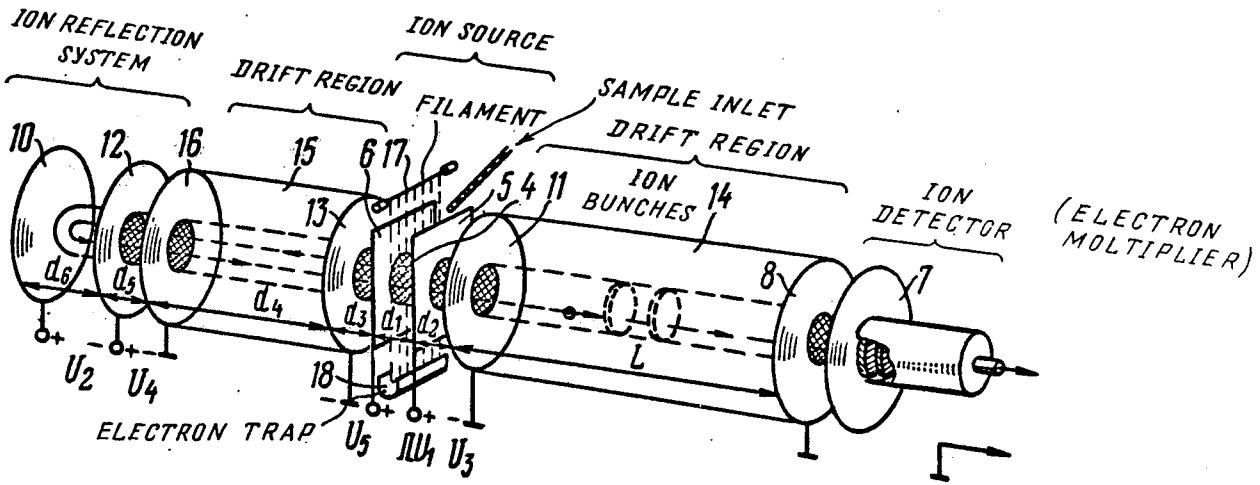
FIG. 5 is an isometric view of a mass spectrometer with two drift spaces.

FIG. 5 shows an isometric view of a mass spectrometer (less the analyzer chamber) having two drift spaces 14 and 15 on both sides of the ion souce $3^{II}$.

The drift space 14 of length L is defined by the electrodes 8 and 11. The other drift space 15 is defined by the electrode 13 and an electrode 16, the latter being a third electrode of the ion reflecting system disposed in parallelism with the former two electrodes 10 and 12 between the electrode 12 and the electrode 13 of the ion source $3^{II}$.

In this case the ion reflecting system is a double-gap one, one gap being defined by the electrodes 10 and 12 while the other by the electrodes 12 and 16.

The electrodes 16, 13, 11 and 8, which form the drift spaces 14 and 15, have equal potentials and are in this case grounded.

FIG. 5 presents an exemplary means for ionizing the substance under study namely the filament 17 which emits electrons passing through the ionization chamber of the ion source $3^{II}$, ionizing the substance studied. The electrons emerging from the ionization chamber are collected by an electron trap 18.

In all the embodiments described hereabove, the electrodes 5, 6, 7, 8, 11, 12, 13 and 16 are constituted by plane metal plates with an opening in the center covered with a fine conducting grid. The electrode 10 is likewise formed as a similar plane metal plate but without a central opening.

The mass spectrometer of this invention operates as follows.

Prior to start-up, the chamber 1 (FIG. 1) of the analyzer is evacuated to a pressure of the order of $10^{-5}$ to $10^{-9}$torr. Then a sample of the substance to be analyzed in the form of gas or vapor is introduced into the ionization chamber of the ion source 3 through the inlet port 9. After this the sample substance is ionized, e.g. by means of electron bombardment. The sample may be preionized and introduced into the ionization chamber in the form of ions.

The studied ions 4 are extracted into the gap between the electrodes 6 and 10 by a negative rectangular pulse of energy $U_1$ and repetition frequency $f$ applied to the electrode 6 by an external generator (not shown in the drawing). In the gap between the electrodes 6 and 10, the ions 4 are retarded to zero velocity and reflected in the reverse direction back to the ion detector 7. The retarding electrostatic field in the gap between the electrodes 6 and 10 is set up by a constant potential difference $U_2$ applied to the electrode 10, relative to the electrode 6, in such a way as to reflect all ions extracted from the source 3 by the pulse $U_1$. To this end, $U_2$ must be greater than the maximum potential difference which accelerates the ions being extracted from the ion source 3.

The packet of ions 4 extracted by the pulse $U_1$ from the source 3 contains ions with a set of energies from $U_{min}$ to $U_{max}$, due mainly to the difference in the paths traversed by the ions 4 in the field of the extracting pulse $U_1$. The ions 4 having different energies, penetrate the retarding field to different depths to be reflected in the reverse direction.

The spread in the trajectories of ions differing in energy in the reflecting system results in the time spread compensation for these ions which arrive at the entrance plane of the ion detector 7 after passing the equipotential drift space of lenght L defined by the electrodes 5 and 8 maintained at earth potential.

The length of the pulse $U_1$ extracting ions from the ionization chamber, must be less than the time of return to the ionization chamber of the lightest of the ions studied, for the latter must return to the ionization chamber while the pulse $U_1$is absent. Having traversed the drift space 14, the ions 4, accelerated by the field in the gap defined by the entrance plane of the detector 7 and the electrode 8, arrive at the ion detector 7. The output of the ion detector 7 is fed to a wideband amplifier (not shown in the drawings) after which it is recorded by an indicator (not shown in the drawing). The mass of the ions 4 under study is determined by the time which elapses from the application of the pulse to the electrode $U_1$ 6 until the signal is formed in ion detector 7 and recorded by the indicator, based on the known mean energy imparted by the pulse $U_1$ to the ions 4 as well as the total effective drift length.

The operation of the mass spectrometer shown in FIG. 2 differs from that of the one described hereabove in that the ion source $3^I$ is a double-gap one (electrodes 6, 5 and 11) so that the ions 4 passing through the source $3^I$ after being reflected are accelerated by potential difference $U_3$ in the gap between the electrodes 5 and 11. This feature improves both the focusing power of the ion-optical system and the resolution of the device. In this case the ions are extracted from the ionization chamber by positive pulse $U'_1$ applied across the electrodes 5 and 2.

The operation of the device illustrated in FIG. 3 differs from that of the device in FIG. 2 in that the ions 4 are retarded in two gaps. The ion reflecting system has two gaps, one retarding the ions between the electrodes 6 and 12 and the other reflecting the ions between the electrodes 12 and 10. Retardation is assured by the constant potential differences $U_4$ and $U_2$ in these gaps. The ion reflecting system consisting of two retarding gaps allows second-order time-of-flight focusing of the ions in energy or the ions moving from the source $3^I$ to the ion detector 7. In this manner the spread in the time-of-flight for ions differing in energy due to the ion path length difference in the extracting pulse field, is compensated more efficiently than in the single gap relfecting system.

As distinct from the device of FIG. 3, the device illustrated in FIG. 4 is capable of accelerating the ions 4 emerging from the source $3^{II}$ toward the ion reflecting system in the gap defined by the electrodes 6 and 13, thereby likewise increasing the focusing power of the ion-optical system and allowing an increase in the resolving power of the device.

As distinct from the device of FIG. 4, the embodiment illustrated in FIG. 5 operates as follows. The ions 4 accelerated in the gap between the electrodes 6 and 13 to a potential $U_5$, get into the drift space 15, traverse it as far as the ion reflecting system and are reflected back toward the ion detector 7. The second drift space 15 permits increasing the total effective drift length without any change in the length of the analyzer chamber. In this case, if the source $3^{III}$ is disposed most advantageously near the ion detector 7, the total effective drift length is almost twice the length of the analyzer chamber.

The ion reflecting system in this case functions similarly to that shown in FIG. 4, the only difference being that the second retarding gap of the system is defined by the electrodes 12 and 16, what with the second drift space 15.

In order to further illustrate the inventive idea of the proposed mass spectrometer, there follow some recommendations as to the choice of parameters of the proposed device and the potentials applied to its electrodes. Also given hereinbelow is a concrete example of how to select the required parametric ratios.

The extracting pulse $U_1$ must be as high as possible (generally of the order of 100 to 300 volts); the accelerating potential differences $U_3$ and $U_5$ must be of the order of $(1\text{–}3)U_1$ ; the retarding potential difference must be of the order of $(0.2\text{–}1)U_5$; and the potential differenc across the electrodes of the reflecting gap of the ion reflecting system ($U_2$) must satisfy the following condition:

$$U_2 \geqq U_{max} + U_5 - U_4.$$

The distance $d_1$ between the electrodes of the ionization chamber must be as small as possible but still 3 to 5 times the width of the ion formation region. The distances $d_2$, $d_3$ and $d_5$ between the electrodes of the accelerating and retarding gaps may be chosen to lie in the range from 1 $d_1$ to 3 $d_1$ conditional on the uniformity of the fields in these gaps. The distance $d_6$ between the electrodes of the reflecting gap of the ion reflecting system must satisfy the following relation:

$$d_6 = 0.1\,(L + 2d_4) \leftarrow \frac{2U_2}{U_3 + U_5},$$

where L and $d_4$ are the lengths of the two ion drift spaces. The values of L and $d_4$ are selected on the basis of the required resolution as well as convenience of source arrangement in the analyzer chamber.

Thus, in a particular case of the device illustrated in FIG. 5, for the following parametric ratios:

$$2d_1 = d_2 = d_3 = 0.25d_4 = 0.01L$$

$$U_5 = U_3 = 3U_1$$

$$U = 1.17U_3,$$

where $d_1$ is the distance between the electrodes 5 and 6;
$d_2$ is the distance between the electrodes 5 and 11;
$d_3$ is the distance between the electrodes 6 and 13;
$d_4$ is the distance between the electrodes 13 and 16;
$d_5$ is the distance between the electrodes 12 and 16;
$d_6$ is the distance between the electrodes 10 and 12;
L is the distance between the electrodes 11 and 8;
$q$ U is the energy of the drifting ions; and
$q$ is the ion charge, the relations for the second-order focusing of the time of flight of ions differing in energy may be written as follows:

$$U_4 \approx 0.61\ U_3$$

$$E_2 \approx 6.4\ U_3/L,$$

where $E_2 = U_2/d_6$.

Analysis indicates that, in a broad range of parameter variations, the space-time focusing error is only 0.5 to 5 percent of the total packet thickness due to the spread of initial energies at $q\Delta U = 0.1$ eV.

Computer calculations show that for the above conditions and at $L = 0.5$ m and $U_3 = 1{,}000$ V, the resolution of the ionoptical system of the proposed mass as determined by spectrometer the mass peak width at half-height may be in excess of 2,000.

What is claimed is:

1. A time-of-flight mass spectrometer, comprising: a vacuum analyzer chamber having an axis; means to maintain vacuum in said chamber; a pulsed ion source in said analyzer chamber; electrodes of said pulsed ion source which are transparent to the ions studied; an ion detector disposed in coaxial relationship with said ion source in said analyzer chamber; a drift space in said analyzer chamber disposed between said ion source and said ion detector; an ion reflecting system disposed in said analyzer chamber in coaxial relationship with said ion source on the side thereof facing away from said ion detector and a gap defined in said analyzer chamber between said reflecting system and said ion source.

2. A time-of-flight mass spectrometer as set forth in claim 1, wherein said pulsed ion source comprises first and second of said electrodes formed as plates perpendicular to the axis of the chamber.

3. A time-of-flight mass spectrometer as set forth in claim 2, wherein said pulsed ion source comprises a third electrode formed as a plate in parallel to said first and second electrodes and disposed in the immediate vicinity thereof on the side facing toward said ion detector.

4. A time-of-flight mass spectrometer as set forth in claim 3, wherein said pulsed ion source comprises a fourth electrode formed as a plate disposed in the immediate vicinity of said first, second and third electrodes in parallel therewith on the side facing toward said ion reflecting system and having a potential to accelerate ions in the direction toward said reflecting system.

5. A time-of-flight mass spectrometer as set forth in claim 4, wherein said ion reflecting system is formed as a primary electrode constituted by a plate opaque to the ion studied and disposed parallel to said electrodes of said ion source.

6. A time-of-flight mass spectrometer as set forth in claim 5, wherein said ion reflecting system comprises a secondary electrode formed as a plate transparent to the ions studied, disposed parallel to said primary electrode and disposed between said primary electrode and said pulsed ion source, said second electrode of the reflecting system having a potential ensuring retardation of ions as they move toward said first electrode.

7. A time-of-flight mass spectrometer as set forth in claim 6, wherein said ion reflecting system comprises a tertiary electrode formed as a plate transparent to the ions studied, disposed parallel to said primary and secondary electrodes and disposed between said secondary electrodes and said pulsed ion source, said tertiary electrode having a potential equal to that of said fourth electrode, and a second drift gap between said tertiary electrode of the reflecting system and the fourth electrode of said pulsed ion source.

8. A time-of-flight mass spectrometer as set forth in claim 1, wherein said ion reflecting system is formed as a primary electrode constituted by a plate opaque to the ions studied and disposed parallel to said electrodes of said ion source.

9. A time-of-flight mass spectrometer as set forth in claim 8, wherein said ion reflecting system comprises a secondary electrode formed as a plate transparent to the ions studied, disposed parallel to said primary electrode and disposed between said primary electrode and said pulsed ion source said secondary electrode of the reflecting system having a potential ensuring retardation of ions as they move toward said primary electrode.

10. A time-of-flight mass spectrometer as set forth in claim 9, wherein said ion reflecting system comprises a tertiary electrode formed as a plate transparent to the ions studied, disposed parallel to said primary and secondary electrodes and disposed between said secondary electrode and said pulsed ion source, said tertiary electrode having a potential equal to that of said fourth electrode of said pulsed ion source, and a second drift gap between said tertiary electrode of the reflecting system and the fourth electrode of said pulsed ion source.

11. A time-of-flight mass spectrometer as set forth in claim 2, wherein said ion reflecting system is formed as a primary electrode constituted by a plate opaque to the ions studied and disposed parallel to said electrodes of said ion source.

12. A time-of-flight mass spectrometer as set forth in claim 11, wherein said ion reflecting system comprises a secondary electrode formed as a plate transparent to the ions studied, disposed parallel to said primary electrode and disposed between said primary electrode and said pulsed ion source said secondary electrode of the reflecting system having a potential ensuring retardation of ions as they move toward said primary electrode.

13. A time-of-flight mass spectrometer as set forth in claim 12, wherein said ion reflecting system comprises a tertiary electrode formed as a plate transparent to the ions studied, disposed parallel to said primary and secondary electrodes and disposed between said secondary electrode and said pulsed ion source, said tertiary electrode having a potential equal to that of said fourth electrode, and a second drift gap between said tertiary electrode of the reflecting system and the fourth electrode of said pulsed ion source.

14. A time-of-flight mass spectrometer as set forth in claim 3, wherein said ion reflecting system is formed as a primary electrode constituted by a plate opaque to the ions studied and disposed parallel to said electrodes of said ion source.

15. A time-of-flight mass spectrometer as set forth in claim 14, wherein said ion reflecting system comprises a secondary electrode formed as a plate transparent to the ions studied, disposed parallel to said primary electrode and disposed between said primary electrode and said pulsed ion source, said secondary electrode of the reflecting system having a potential ensuring retardation of ions as they move towards said primary electrode.

16. A time-of-flight mass spectrometer as set forth in claim 15, wherein said ion reflecting system comprises a tertiary electrode formed as a plate transparent to the ions studied, disposed parallel to primary and secondary electrodes and disposed between said secondary electrode and said pulsed ion source, said tertiary electrode having a potential equal to that of said fourth electrode, and a second drift gap between said tertiary electrode of the reflecting system and the fourth electrode of said pulsed ion source.

17. A time-of-flight mass spectrometer comprising:

a vacuum analyzer chamber having an axis;

means for maintaining vacuum in said chamber to ensure a length of free flight of ion in said analyzer chamber considerably greater than the geometric size of the chamber itself;

a pulsed ion source arranged in said chamber;

electrodes of said ion source which are transparent to the ions being studied;

means for forming ions being studied in the form of a stream between said electrodes of the ion source;

an ion detector disposed in coaxial relationship with said ion source in said analyzer chamber;

a drift sapce in said analyzer chamber disposed between said ion source and said ion detector;

an ion reflecting system disposed in said analyzer chamber in coaxial relationship with said ion source on the side thereof facing away from said ion detector;

a gap defined in said analyzer chamber between said ion reflecting system and said ion source;

means for generating in said gap an ion reflecting electric field compensating for the energy spread of ions in the stream formed in said ion source.

* * * * *